United States Patent [19]

Silberman

[11] 4,302,005

[45] Nov. 24, 1981

[54] LATERALLY PIVOTED WEIGHT TRAINING DEVICE

[75] Inventor: Ira J. Silberman, Opelika, Ala.

[73] Assignee: Diversified Products Corporation, Opelika, Ala.

[21] Appl. No.: 20,214

[22] Filed: Mar. 13, 1979

[51] Int. Cl.[3] ..... A63B 23/00

[52] U.S. Cl. ..... 272/94; 272/117

[58] Field of Search ..... 272/94, 93, 76, 117, 272/DIG. 4, 900, 144, 142, 136, 135, 134, 116, 119; 128/25 R

[56] References Cited

U.S. PATENT DOCUMENTS

| | | | |
|---|---|---|---|
| 3,010,720 | 11/1961 | Allard | 272/117 |
| 3,077,613 | 2/1963 | Mayer | 272/900 X |
| 3,850,430 | 11/1974 | Hamilton | 272/117 |
| 3,918,710 | 11/1975 | Niebojewski | 272/134 X |
| 4,066,259 | 1/1978 | Brentham | 272/94 |
| 4,093,212 | 6/1978 | Jacques | 272/DIG. 4 X |

FOREIGN PATENT DOCUMENTS

| | | | |
|---|---|---|---|
| 1016724 | 9/1952 | France | 272/81 |

OTHER PUBLICATIONS

Power Neck Machine—Hydra-Gym Athletics, Inc., Coach and Athlete Magazine, Dec. 1976.

*Primary Examiner*—Richard C. Pinkham
*Assistant Examiner*—William R. Browne
*Attorney, Agent, or Firm*—Schuyler, Banner, Birch, McKie & Beckett

[57] ABSTRACT

An exercising device for developing primarily the muscles of the neck. The device comprises a pivoted weight support having a cushioned lower surface which is raised and lowered by motions of the user's head. The device may be supported in mounting brackets affixed to the legs of an exercising bench. The exercising device has a generally J-shaped frame having a generally upstanding lower portion and a generally arched upper portion which has a free end. A stop device is carried by the frame at the free end of the upper portion for engaging and supporting a laterally extending portion of the weight support when the latter is in its lowest rest position.

17 Claims, 2 Drawing Figures

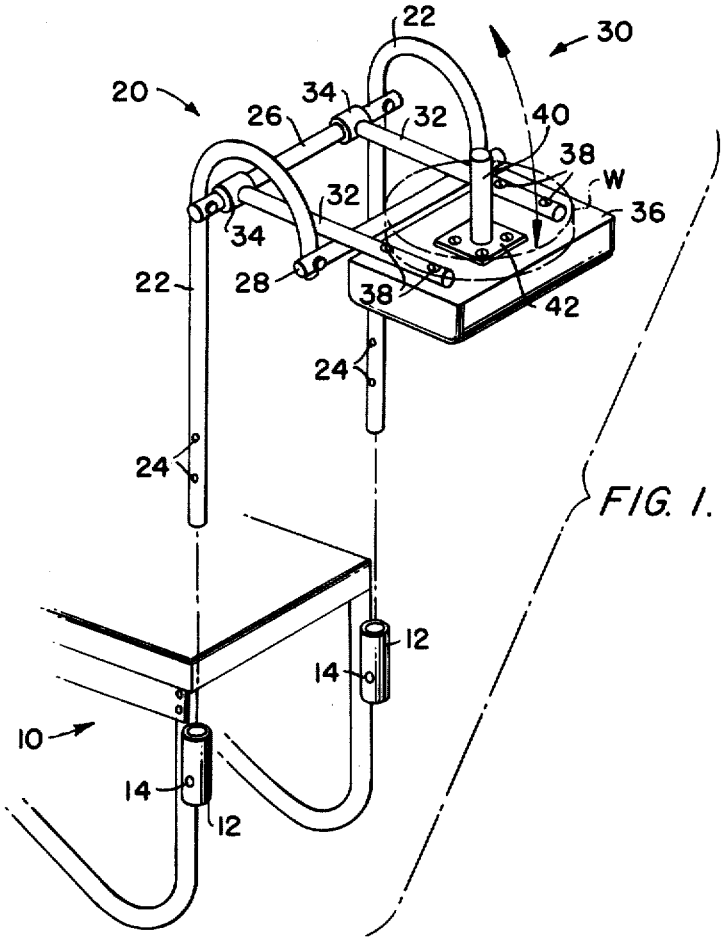
FIG. 1.
FIG. 2.
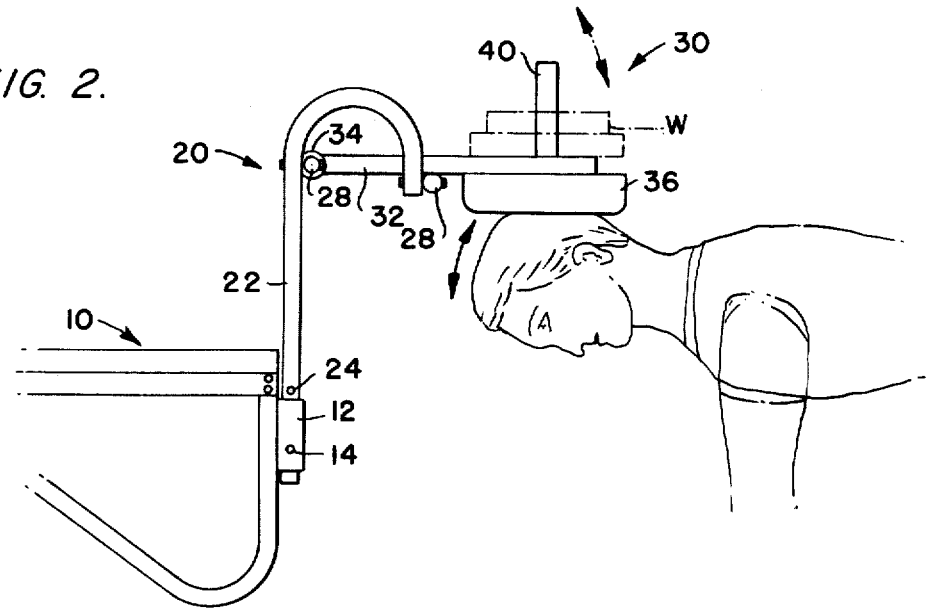

LATERALLY PIVOTED WEIGHT TRAINING DEVICE

BACKGROUND OF THE INVENTION

1. Field of the Invention

The present invention relates to exercising devices for developing and conditioning various parts of the body and, more particularly, for developing neck muscles.

2. Description of the Prior Art

Many exercising devices have been developed for improving muscular strength and endurance of various parts of the body. Those that have been developed for exercising the muscles of the neck typically incorporate cumbersome and uncomfortable head-engaging harnesses to which a force resister, such as a weight, is applied. Many of these are portions of complex and costly "universal" exercising machines which are not suitable for home use.

SUMMARY OF THE INVENTION

Accordingly, it is an object of the present invention to obviate the above-noted disadvantages of the prior art by providing a simple, inexpensive and comfortable exercising device for developing the muscles of the neck and other portions of the body.

Another object of the invention is to provide such a device which is used in conjunction with the weights of a common barbell set.

Another object of the invention is to provide such a device which does not require a complex and cumbersome head-engaging harness for operation.

Another object of the invention is to provide such a device which is designed to be easily assembled by the consumer using a minimum number of conventional hand tools.

Another object of the invention is to provide such a device which is adjustable to suit the needs of various users.

These and other objects of the present invention are accomplished by providing an exercising device for use with interchangeable weights of selected quantity comprising frame means for supporting the device in a stationary position relative to a user-supporting surface, weight support means pivotally mounted on the frame means for rotation about a substantially horizontal axis, and including a user-engageable lower lifting surface against which a generally upward exercising force is applied to pivot the weight support means about the axis and raise the weights supported thereon, and stop means engaged by the weight support means for limiting its downward movement to a rest position wherein the weights are disposed substantially laterally of the vertical plane containing the axis. The frame means comprises an inverted, generally J-shaped frame having a generally upstanding lower portion and a generally arched upper portion joined at one end to the lower portion along a back side of the frame and having a free opposite end. The weight support means is pivoted to the back side of the frame, and the stop means is carried by the frame in the region of the free end of the upper portion.

Preferably, the weight support means comprises a pivoted padded board having an upstanding post for engaging the holes of the apertured weights of a barbell set. The frame means preferably comprises two spaced tubular legs which are adapted to be adjustably supported in mounting brackets affixed to the legs of an exercising bench. A bench of this type is disclosed in applicant's copending application Ser. No. 12,487, filed Feb. 15, 1979 for "Exercising Apparatus". Such a bench may include a barbell rest assembly for supporting a barbell above the bench. Two legs at one end of the bench have mounting brackets for adjustably supporting the frames of other exercising devices.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

FIG. 1 is a perspective view of the exercising device according to the invention showing its use in conjunction with an exercising bench having mounting brackets for securing the device thereto; and FIG. 2 is a side elevational view of the same illustrating its manner of use.

DESCRIPTION OF THE INVENTION

In the preferred embodiment shown in the figures, most of the structural elements of the invention are tubular steel members which are secured together by bolted connections. This arrangement permits the components of the device to be marketed in a compact package, and readily assembled using conventional hand tools. Of course, other types of members of various cross-section may be used, and they may be secured together by other means, such as welding.

The exercising device according to the invention includes a frame 20 comprising a pair of laterally spaced, inverted J-shaped members 22 which may be supported in the mounting brackets 12 of an exercising bench of the type disclosed in applicant's aforesaid application Ser. No. 12,487. J-shaped members 22 include vertically spaced holes 24 which may be selectively aligned with holes 14 in brackets 12 to adjustably secure the device at a desired height from the floor by means of shear pins (not shown). A tubular crosspiece 26 is bolted across the back sides of the J-shaped members 22 just beneath their curved upper portions. A tubular strut 28 is bolted across the tips of the curved portions.

A pivoted weight support 30 comprises two spaced parallel arms 32 which are pivotally mounted on crosspiece 26 by means of cylindrical collars 34 welded to the ends of arms 32. The free ends of arms 32 are secured to a padded board 36 by means of screws 38. Board 36 may comprise a plywood base having a lower padded surface of vinyl-wrapped polyurethane foam. Conventional flanged tubular nuts (not shown) are secured in predrilled holes in the plywood base and are engaged by screws 38 to secure board 36 to the arms 32.

Selected apertured weights W are retained on weight support 30 by means of an upright post 40 welded to a plate 42. Plate 42 is screwed to the top of board 36 by flanged tubular nuts (not shown) or other equivalent means. Arms 32 are spaced apart so that the weights W placed on post 40 are supported on the arms themselves above board 36. In this way, all of the weight is borne by the arms 32, thereby preventing undue stresses on the board 36 and its connections with arms 32.

Referring to FIG. 2, the operation of the exercising device will now be described. For developing the muscles at the back of the neck and the shoulders, the user adjusts the height of the device relative to the floor such that, when on all fours, the back of the user's head, when held substantially horizontal, will contact the padded underside of board 36. The user then lifts his head to pivot weight support 30 about crosspiece 26 and raise weights W. The weights need be raised only a small distance. The user then lowers his head to permit weight support 30 to come to its rest position with arms 32 in contact with strut 28, which acts as a stop. The head raising and lowering movements are repeated for a desired number of times to complete the exercise.

The exercising device may also be used to develop muscles at the sides of the neck by raising and lowering the weight support with the side of the head. In this situation, the exercising device would be lowered to a position such that the user can comfortably support himself on the floor on his side and elbow or in any other comfortable manner while performing the desired exercise. Of course, the exercising device of the invention is not limited to performing neck muscle developing exercises, and may be used to develop any portions of the body which can conveniently be arranged beneath weight support 30 to raise and lower weights W.

Advantageously, the rest position of weight support 30, with arms 32 abutting strut 28, is such that weights W are disposed substantially at a maximum horizontal distance from the pivot axis defined by crosspiece 26. In this manner, the lifting force exerted by the user can be conveniently directed substantially upwardly against board 36. This is the most efficient arrangement since the weight moment of the weight support 30 and weights W about the pivot axis is a maximum. Of course, the rest position of weight support 30 could be arranged so that weights W are disposed at a lesser horizontal distance from the pivot axis. The device could still function in this manner, although not as effectively, as long as weights W are disposed substantially laterally of the vertical plane containing the pivot axis.

It will be obvious to one of ordinary skill that numerous modifications may be made without departing from the true spirit and scope of the invention which is to be limited only by the appended claims.

I claim:

1. An exercising device for use with interchangeable weights of selected quantity comprising:

an inverted, generally J-shaped frame having a generally upstanding lower portion and a generally arched upper portion joined at one end to said lower portion along a back side of said frame and having a free opposite end, said frame being adapted to be supported in a stationary position relative to a user-supporting surface;

weight support means pivoted to said back side of said frame and extending laterally therefrom for pivotal movement about a substantially horizontal axis, said weight support means being adapted to support weights of selected quantity and including a user-engageable lower lifting surface against which a generally upward exercising force is applied to pivot said weight support means about said axis and raise the weight supported thereon; and stop means carried by said frame at said free end of said upper portion for engaging and supporting the laterally extending portion of said weight support means in a lowest rest position wherein the weights are disposed substantially laterally of the vertical plane containing said axis.

2. An exercising device according to claim 1 wherein said lifting surface is disposed beneath said weights.

3. An exercising device according to claim 1 wherein said lifting surface is substantially planar.

4. An exercising device according to claim 3 wherein said lifting surface is padded.

5. An exercising device according to claim 1 wherein said weight support means comprises two parallel spaced arms each pivotally attached at one end of said back side of said frame and secured at their other ends to a board having said lifting surface.

6. An exercising device according to claim 5 wherein said stop means underlies said arms intermediate said pivotal attachment and said board.

7. An exercising device according to claim 5 wherein said weight support means further comprises a generally upright post secured to the top of said board for engaging the holes of apertured weights.

8. An exercising device according to claim 7 wherein said arms overlie said board flanking said post and are spaced apart so as to support said weights above said board.

9. An exercising device according to claim 5 wherein said lifting surface is padded and comprises the lower surface of said board.

10. An exercising device according to claim 5 wherein said frame comprises two laterally spaced inverted J-shaped members, and a crosspiece interconnecting the lower portions of said J-shaped members, said arms being pivoted to said crosspiece; and said stop means comprises a substantially horizontal strut interconnecting the free ends of said arched portions of said J-shaped members and underlying said arms.

11. An exercising device according to claim 10 wherein said weight support means further comprises a generally upright post secured to the top of said board for engaging the holes of apertured weights.

12. An exercising device according to claim 11 wherein said arms overlie said board flanking said post and are spaced apart so as to support weights above said board.

13. An exercising device according to claim 12 wherein said lifting surface is padded and comprises the lower surface of said board.

14. An exercising device according to claim 13 wherein said crosspiece is tubular, said arms having cylindrical collars at their pivoted ends which surround said crosspiece.

15. An exercising device according to claim 14 wherein said J-shaped members are tubular and are spaced so as to be supportable in mounting brackets affixed to the legs of an exercising bench.

16. An exercising device according to claim 1 adapted to be supported on an exercising bench having spaced legs, wherein said frame comprises two tubular legs spaced so as to be supportable on the legs of the exercising bench.

17. An exercising device according to claim 1 wherein said weight support means extends substantially horizontally away from said axis when in its rest position.

* * * * *